US006676029B2

(12) United States Patent
Mitchell

(10) Patent No.: US 6,676,029 B2
(45) Date of Patent: Jan. 13, 2004

(54) STREAM STRAIGHTENER FOR FLUID FLOWING AND DISPENSING NOZZLE

(75) Inventor: Thomas O. Mitchell, St. Louis, MO (US)

(73) Assignee: Husky Corporation, Pacific, MO (US)

( * ) Notice: Subject to any disclaimer, the term of this patent is extended or adjusted under 35 U.S.C. 154(b) by 4 days.

(21) Appl. No.: 10/085,516

(22) Filed: Mar. 1, 2002

(65) Prior Publication Data

US 2003/0164415 A1 Sep. 4, 2003

(51) Int. Cl.[7] ..... B05B 17/00; B05B 1/14

(52) U.S. Cl. ..... 239/1; 239/504; 239/590; 239/590.5; 141/206

(58) Field of Search ..... 239/461, 590, 239/590.5, 428.5, 419.5, 504, 1; 222/547, 564; 141/206

(56) References Cited

U.S. PATENT DOCUMENTS

| | | | | |
|---|---|---|---|---|
| 597,842 A | * | 1/1898 | Edmands | 239/590.5 |
| 2,874,735 A | | 2/1959 | Boone | |
| 3,126,925 A | | 3/1964 | Boone | |
| 3,486,700 A | * | 12/1969 | Bristow | 239/590.5 |
| 3,556,410 A | * | 1/1971 | Arant | 239/590.5 |
| 4,351,375 A | | 9/1982 | Polson | |
| 4,809,753 A | | 3/1989 | Fink, Jr. | |
| 4,848,672 A | * | 7/1989 | Matsumoto et al. | 239/590.5 |
| 5,141,037 A | | 8/1992 | Carmack et al. | |
| 5,645,115 A | | 7/1997 | Kesterman et al. | |
| 5,765,609 A | | 6/1998 | Dalhart et al. | |
| 6,024,140 A | | 2/2000 | Garrison et al. | |
| 6,290,149 B1 | * | 9/2001 | Daniel et al. | 239/590 |

OTHER PUBLICATIONS

OPW Fueling Components Group Bulletin Feb./Mar. 1989 vol 9 No 1.

OPW "Flow Lock Spout" brochure Jun. 2, 1989.

* cited by examiner

*Primary Examiner*—Steven J. Ganey
(74) *Attorney, Agent, or Firm*—Paul M. Denk

(57) ABSTRACT

A choke for reducing spray of fuel exiting a fuel dispensing system nozzle spout having an annular frame positioned within the spout adjacent the output opening. The choke has a concentric hub connected to the frame by three, relatively narrow struts positioned equidistant around the hub. The hub has a solid, cylindrical fore section tubular aft section. A duct extends from the tubular aft section, through one strut and the frame, to the sensing port. Fuel flowing through the spout toward the output opening, it is slowed and divided into three streams by the choke, flows along the hub fore section and converges, compressed and linearly aligned, at the output opening of the spout to reduce spraying of fuel at the output opening of the spout and avoid unwanted shut-off.

18 Claims, 3 Drawing Sheets

STREAM STRAIGHTENER FOR FLUID FLOWING AND DISPENSING NOZZLE

CROSS-REFERENCE TO RELATED APPLICATIONS

None

BACKGROUND OF THE INVENTION

The invention relates generally to fuel dispensing nozzles and, more specifically, to an improved apparatus for straightening the flow of fuel out of tip of the nozzle spout.

In general, a fuel dispensing system, such as a system for dispensing liquid fuel such as gasoline at a gas or service station, includes a storage tank, a pump, a delivery hose connected at one end to the pump and a dispensing nozzle at the other end of the hose. The dispensing nozzle generally has a handle structure, an actuator for opening the nozzle and permitting flow, and an elongated spout designed to fit into a vehicle fuel tank fill neck.

The pattern of the fuel as it exits the spout can affect how well the nozzle can fill up a vehicle. If the pattern fans out, then there are problems filling up the vehicle tank. In general, when the vehicle tank is filled up the air/vapors in the empty tank have to exit the tank through the same conduit, or fill neck, that the fuel travels into the tank. This conduit is generally larger than the spout O.D. If the spray pattern of fuel expands out to fill the I.D of the conduit, the exiting air/vapors have to exit back through the fuel flow and tend to blow some of the fuel back onto the nozzle sensing port which is operatively connected to a shut-off, as known in the art. This blowback will cause the nozzle to shut off. This requires the customer to restart the nozzle, which is inconvenient for the customer. If the pattern of fuel does not expand, then there is room in the conduit for the air/vapors to escape without affecting the fuel flow or prematurely shutting off the nozzle.

With nozzles of known designs, there can be a fitting on the bottom inside of the spout. This fitting interrupts the flow of fuel and creates the spray pattern. In the past, others have attempted to control the flow by employing elongated X-shaped or V-shaped deflectors within the nozzle adjacent the discharge opening. The devices were made of metal, could deteriorate or corrode, and sometimes interfered with the sensing port that is connected to an automatic shut-off to halt fuel flow when the vehicle fuel tank is full.

Some nozzles avoid this fitting by adding a separate coaxial flow chamber for the fuel to flow out of. These types of nozzles have a good "non-spray" flow pattern, but by causing the fuel to flow through a smaller coaxial tube, the exit velocity is much greater than with a conventional spray spout. This increased exit velocity can cause problems with fill necks that are not straight. This jet of fuel will hit a bend in the fill neck and break up spraying back on the sensing port, resulting in the same shut of condition that is caused by an expanding spray pattern.

It would be helpful, therefore, to have an apparatus in the spout that controls the flow of fuel out of the nozzle, resulting in a tight, low velocity stream.

SUMMARY OF THE INVENTION

It is among the various aspects and objects of the present invention to provide an apparatus for positioning within the discharge nozzle of the fuel-dispensing nozzle to provide for a tightened and low velocity stream of fuel from the nozzle to control undesirable spraying of fuel.

Another aspect of the invention is to provide for such an apparatus that provides tightened and low velocity stream of fuel from the nozzle to control undesirable shut off of fuel flow.

One aspect of the invention is directed toward a choke positionable within the discharge spout of the fuel-dispensing nozzle to constrict and align the flow of fuel and slow the velocity of the fuel stream.

A preferred embodiment of the choke of the present invention includes an annular frame having a circumference slightly less than the circumference of the bore of the nozzle spout so that the body fits snugly within the spout adjacent the output opening of the spout. The choke has a concentric hub connected to the frame by three, relatively narrow struts positioned equidistant around the hub. The hub has a generally solid, cylindrical fore section extending toward the spout opening and an open ended, tubular aft section. A duct extends from the tubular aft section, through one strut and the frame, to the sensing port which is operatively connected to a shut-off.

When fuel flows through the spout toward the output opening, it is slowed and divided into three streams at the choke. The streams of fuel flow along the fore section of the hub and converge, somewhat compressed and generally aligned, near the output opening of the spout. The compressed, linearly align fuel stream then exits the output opening with less spraying or splashing.

BRIEF DESCRIPTION OF THE DRAWINGS

Corresponding reference numerals indicated corresponding elements throughout the various drawings.

DESCRIPTION OF THE PREFERRED EMBODIMENT

Figure 1:
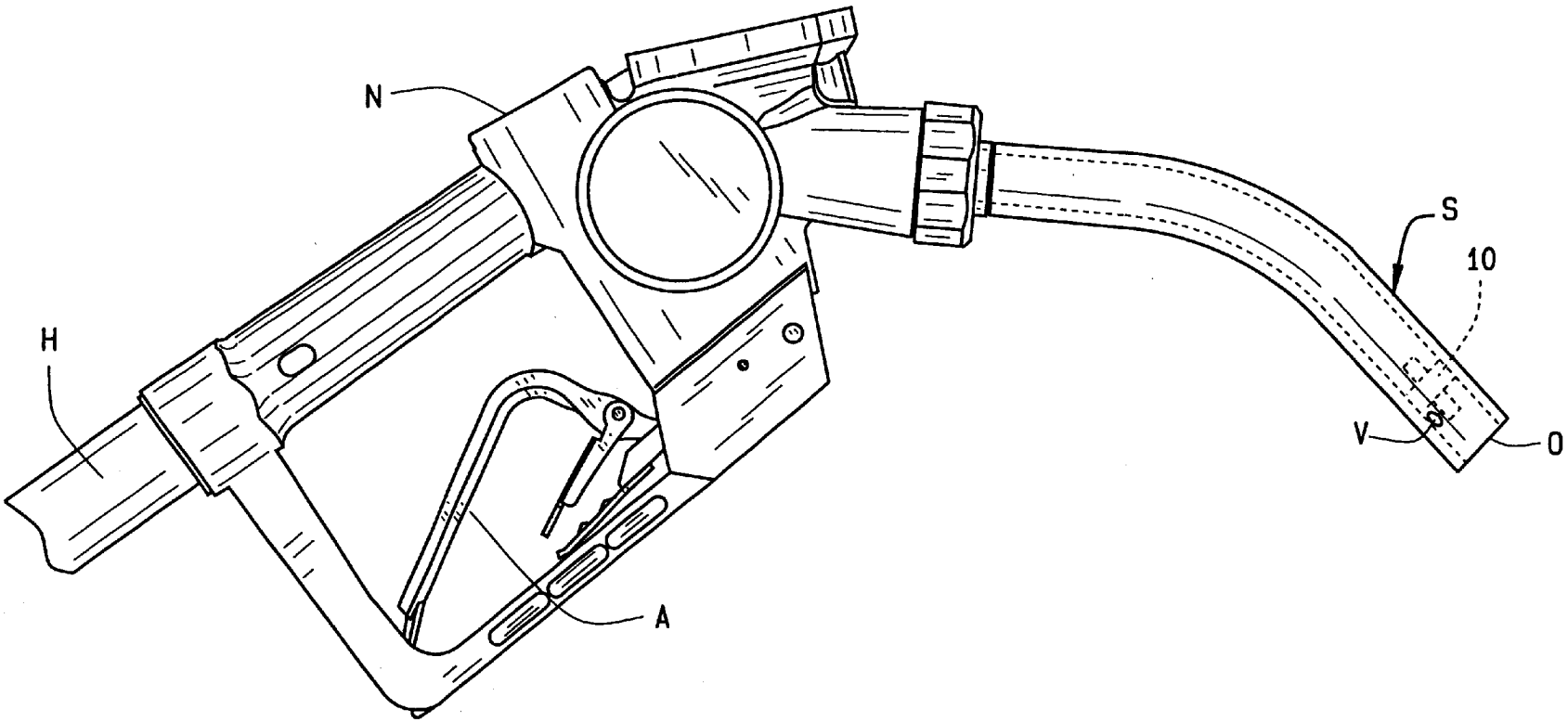
FIG. 1 is a side elevational view of a conventional fuel dispensing system dispensing nozzle.

The novel fuel flow straightener of the present invention is generally intended to be installed in the spout of a fuel dispensing system dispensing nozzle indicated generally as N in FIG. 1. Nozzle N is connected to a dispensing pump (not shown) by hose H and includes an actuator A to start and stop flow through the nozzle and a dispensing spout S. Spout S is configured and sized to allow introduction into the fill tube of a vehicle or into a storage container, such as a gas can. The spout has a discharge orifice O at one end and the opposite end is in fluid communication with the fluid flowing from the pump through the nozzle. Each nozzle may include a sensing port opening (e.g. opening V in FIG. 5) operatively connected to a conventional shut-off mechanism that stops the flow of fuel when the receptacle is full, as known in art. In any event, nozzle N is intended to represent any type or design of a fuel dispensing nozzle with which the flow straightener of the present invention may be used.

Figure 2:
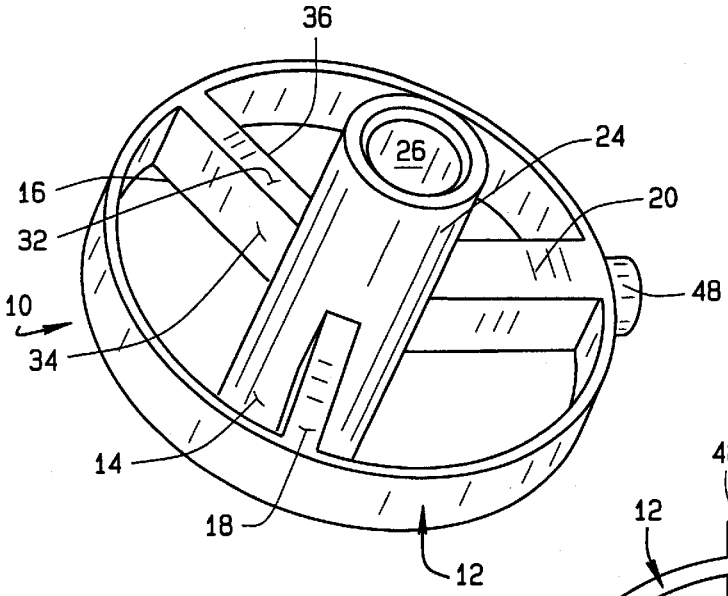
FIG. 2 is a rear perspective view of the fuel flow straightener of the present invention.
Figure 3:
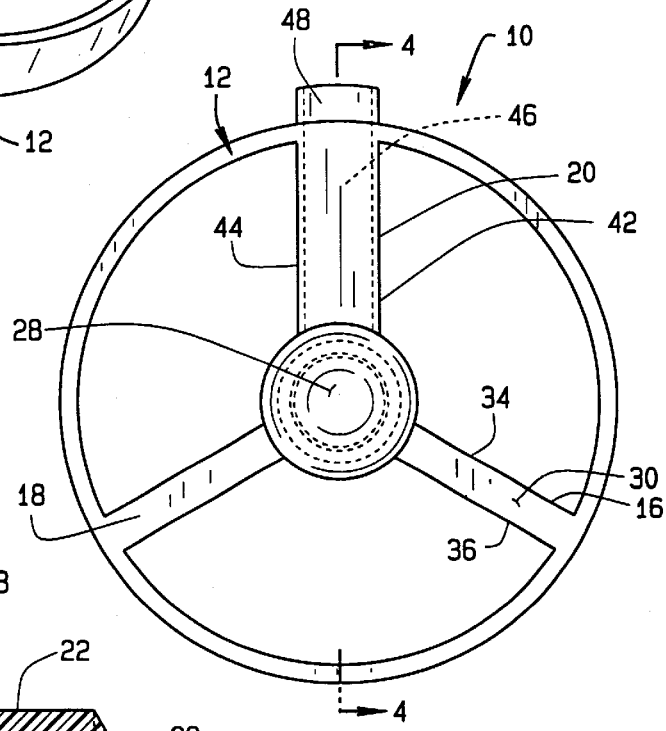
FIG. 3 is a front elevational view thereof.
Figure 4:
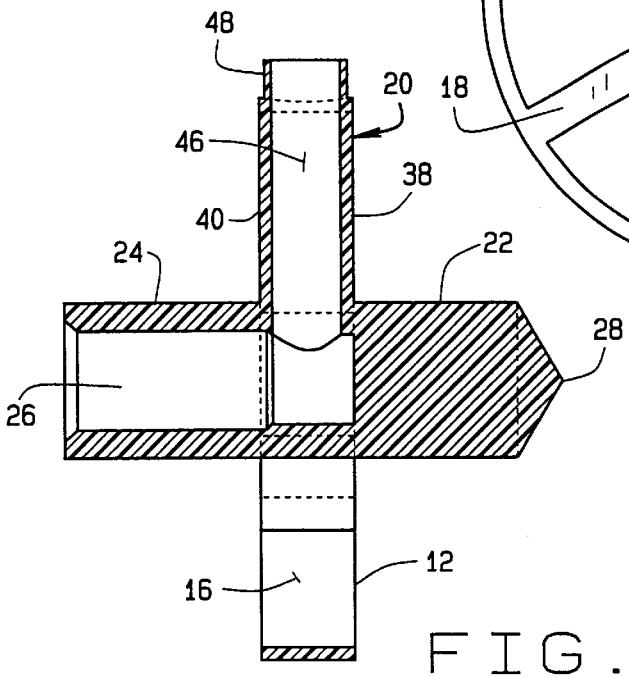
FIG. 4 is a cross-sectional view taken along line 4—4 of FIG. 3.

The novel fuel flow straightener, which can be referred to as a choke, is indicated generally by reference numeral 10 in FIGS. 2–4. Choke 10 has an annular frame 12, a concentric hub 14 and three struts 16, 18 and 20. Frame 12 has a diameter which is slightly less than the inside diameter of the spout S in which it will be installed. Frame 12 is depicted as being annular in the illustrated environment because the cross-section of spout S is annular. It is understood that frame 12 could have any other configuration corresponding to the cross-section of the spout or discharge apparatus in which it is installed, including ovoid, rectangular or the like.

As shown in FIG. 4, hub 14 has a relatively elongated cylindrical configuration which arbitrarily will be described has comprising two sections, a solid fore section 22 and an open-ended, tubular aft section 24 having a bore 26 formed therein. Fore section 22 is generally cylindrical in configuration and has a conical tip 28.

Struts 16, 18 and 20 are position an equidistance about the hub at approximately 120° angles and connect hub 14 to frame 12 in a manner that adds rigidity and strength to the apparatus. Struts 16 and 18 are identical in structure, being, in the exemplary embodiment, solid rectangular members having front and rear surfaces 30, 32 and opposed side surfaces 34, 36, all of substantially the same length. Side surfaces 34 and 36 are wider than the front and rear surfaces 30, 32, respectively, having the same width as frame 12. As will be appreciated, the struts are relatively narrow so that they can slow and divide the flow but do not cause excessive resistance to, or turbulence in the fuel As best seen in FIG. 4, spoke 20 has a different configuration, having front and rear walls 38, 40 and side walls 42, 44. The four walls define an inner cavity 46 that is in fluid communication with bore 26. Spoke 20 includes a hollow contiguous annular extension 48 that bisects, and is located on the outer surface of, frame 12 forming an open duct through the frame at that point. As will be appreciated from viewing FIG. 4, there is a continuous open flow pathway from extension 48, through chamber 46 and bore 26. Extension 48 is dimensioned so that it will fit into a sensing port V, when the choke is installed in a nozzle spout and allow the automatic shut-off to function properly in the presence of fuel flow past the choke. If the choke 20 is intended to be used in a discharge apparatus that does not have a sensing port opening, strut 20 can be constructed the same as struts 16 and 18.

As explained above, the circumference of frame 12 is such that the choke fits snugly inside the spout near the output opening of the spout, with extension 48 positioned inside the opening and secured, either by a tight friction or with other acceptable means such as an adhesive or the like. The exemplary embodiment of choke 10 is constructed or molded from a substantially rigid yet resilient chemical resistant material, for example a resinous plastic material such as Delrin® (Dupont, Wilmington, Del.). However, it will be understood that the choke of the present invention can be constructed from any acceptable material such as metal, plastic, resin, or any other suitable material now known or unknown, in one piece or an assembly of pieces, without departing from the 15 scope of the appended claims.

The choke 10 is employed to reduce spraying as a fluid exists the discharge orifice of a fluid dispensing apparatus, such as a spout. The term spraying is intended to mean the common definition of spraying, including, but not limited to, any undesired or random discharge of some of the fluid. In the illustrated application, the fuel flows as a stream through its fluid flow path and the spout and eventually through choke 10. Extension 48 allows the automatic shut-off to function, if one is present.

The flowing fuel stream is slightly slowed and divided into three streams at the choke by the struts, with the relatively wider side walls of the strut forming stream guides. The three streams flow separately along the side walls of the struts and the fore section of the hub and converge at a point beyond the pointed tip of the hub, where they form a more compressed or constrained stream comprised of three linearly aligned streams. This convergence occurs very near the output opening O of the spout. Consequently, because the stream of fuel is slightly slowed and relatively linear and compressed or constrained, there is less spraying of the fuel as it exists the spout.

Figure 5:
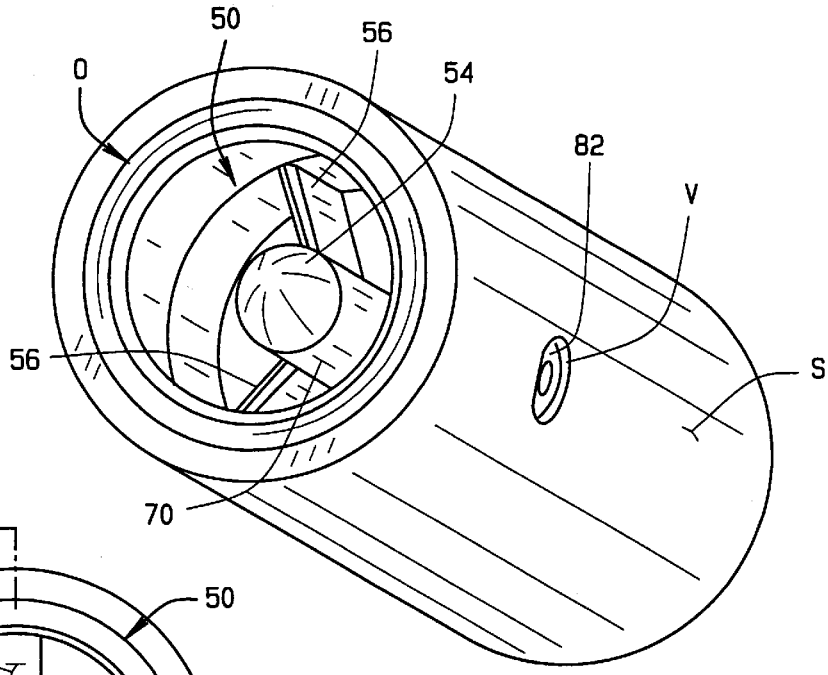
FIG. 5 is a perspective view of the flow straightener of the present invention installed in the spout of a fuel dispensing nozzle.
Figure 6:
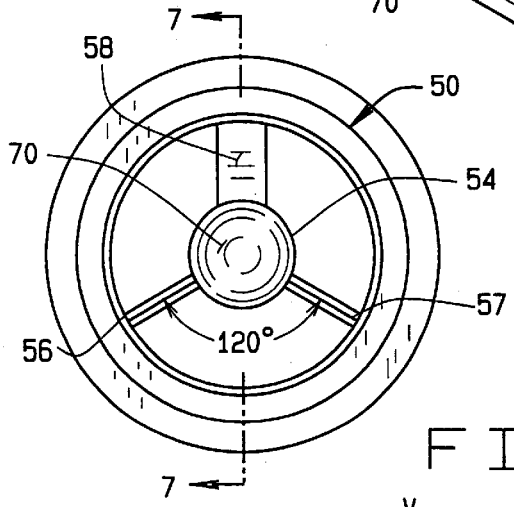
FIG. 6 is a front elevational view of an alternative embodiment of the fuel flow straightener of the present invention installed in a spout.
Figure 7:
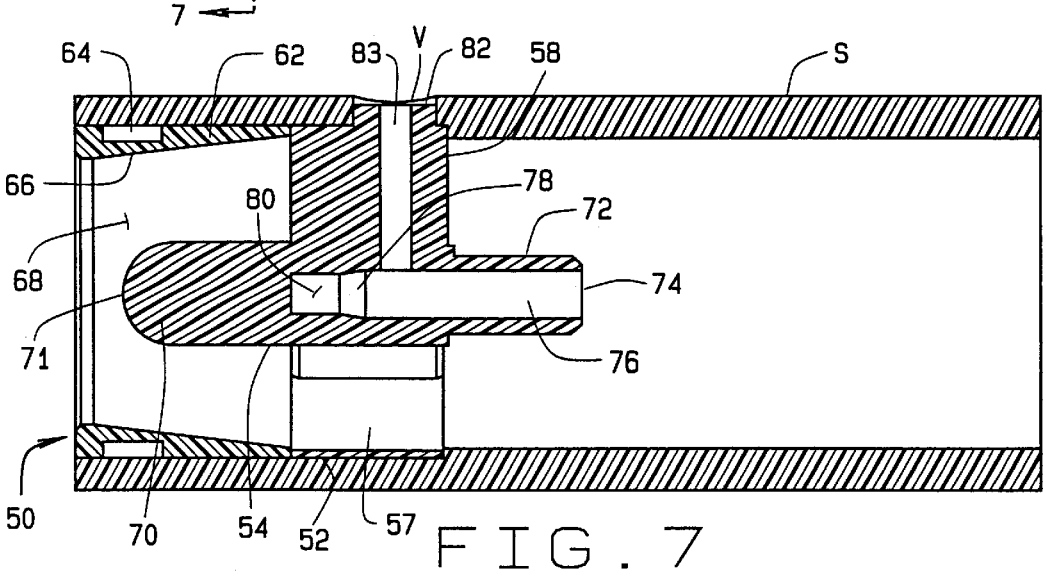
FIG. 7 is a cross-sectional view thereof taken along line 7—7 of FIG. 6.

FIGS. 5 through 7 illustrate another exemplary embodiment of the flow straightener of the present invention, indicated generally in the drawings as numeral 50. Referring to FIGS. 6 and 7, straightener or choke 50 includes a generally cylindrical frame 52 with a concentric hub 54 secured to the body by three struts 56, 57 and 58 extending at 120° from the hub. It will be noted that frame 52 is longer than annular frame 12 of choke 10. Hub 54 is positioned near the posterior end of the frame 52 and has an anterior section defined by an anterior frame wall 62. Frame wall 62 has circumferential groove 64 formed in the outer surface. The inner surface 66 of the anterior frame wall is tapered to define a bore 68 that is tapered in from rear to front.

Hub 54 has a solid cylindrical fore section 70 with a rounded tip 71 and a concentric, open-ended tubular aft section 72 with inner bore 74. Described aft to fore, bore 74 has a first section 76, a second tapered second section 78, and a third concentric section 80.

Struts 56 and 57 are relatively narrow rectangular members having relatively longer sidewalls. The struts extend from the hub at approximately 120° angles. Strut 58, however, is substantially wider than the other struts, as seen in FIG. 6. As shown in FIGS. 5 and 7, there is an annular extension 82 on the top of strut 58 which is configured to fit into the sensing port V. There is a duct 83 connecting the automatic shut-off sensing port to bore 74.

Choke 50 can be constructed or molded from the materials described above. The circumference of choke 50 is such that it fits snugly in the spout. The anterior frame wall 62 can be slightly compressed at circumferential groove 64 when the choke is inserted in the spout. Extension 82 fits into the sensing port and the resilient anterior frame wall 62 then is biased against the inner wall of the spout. The choke can be maintained in position in this manner or further secured in place with a chemically compatible adhesive or the like.

In use, the fuel flows as a stream through the spout and eventually through choke 50. Extension 82 allows the nozzle automatic shut-off to function. The flowing fuel stream is slightly slowed and divided into three streams at the choke by the struts. The three streams flow substantially separately along strut walls and the fore section of the hub and converge at a point beyond the tip of the hub, very near the output orifice of the spout, where they form a more compressed stream comprised of three linearly aligned streams. In choke 50, the stream is further constrained at the outflow opening by the tapered bore 68. Consequently, because the fuel stream is relatively slowed, linear and compressed or constrained, there is substantially less spraying of the fuel as it exists the spout output orifice. Blow back is eliminated and unwanted shut-off is avoided.

Although a major application of the flow straightener of the present invention is its use in a fuel dispensing nozzle, it will be understood that the invention can be employed in any fluid discharge or dispensing apparatus, other than fuel, without departing from the scope of the invention. For example, the straightener can be employed in a liquid dispensing spout in another environment, such as a water hose, beverage dispenser, or any other fluid flow or dispensing system without departing from the scope of the appended claims. Therefore, the foregoing description and accompanying drawings are intended to be illustrative of the best mode of working the invention and described the invention in one particular application for brevity and clarity and are not intended to be construed in a limiting sense.

What is claimed is:

1. An apparatus for straightening the stream of a fluid flowing through a fluid flow path as it exits the discharge orifice of a fluid dispensing device to reduce spraying of the fluid at the discharge orifice, comprising:

a frame positioned within the fluid flow path of the discharge device;

a hub concentrically positioned within the frame, the hub having a front section orientated toward the discharge orifice and a rear section orientated toward the fluid stream, the rear section of the hub has a bore formed therein;

a plurality of spokes extending between the hub and the frame and positioned about the hub so as to divide the stream of fluid flowing through the choke into a plurality of separate substantially linearly aligned streams, whereby the separate linearly aligned streams flow along the front section of the hub and converge at the discharge orifice in a substantially constricted, linearly aligned stream and thereby straightened to reduce spraying of the fluid at the discharge orifice.

2. The apparatus of claim 1 wherein one of said struts has a duct formed therein, said duct being in fluid communication with an automatic shut-off sensing port formed in the fluid dispensing device.

3. The apparatus of claim 2 wherein said strut having a duct further comprises an extension positioned on an outer surface of the frame.

4. The apparatus of claim 1 wherein said front section of the hub is elongated and cylindrical.

5. The apparatus of claim 4 wherein the front section of the hub has a conical tip thereon.

6. The apparatus of claim 1 comprising three struts.

7. The apparatus of claim 1 wherein the frame has an annular configuration.

8. The apparatus of claim 1 wherein said frame has a forward section having a tapered bore formed therein.

9. The apparatus of claim 8 wherein said forward section has a circumferential groove formed in an outer surface.

10. The apparatus of claim 1 wherein said bore in said rear section of the hub has a first section, a tapered second section and a third section which is concentric to said first and second sections.

11. The apparatus of claim 1 formed from a substantially rigid, resilient resin material.

12. A dispensing apparatus for dispensing flowing fluid from a fluid dispensing system comprising:

a substantially elongated body having a fluid flow path formed therein, said body having a discharge orifice at a first end and being in fluid communication with a source of fluid at the opposite end; and means within said fluid flow path adjacent the discharge orifice for slowing, dividing and compressing the fluid flowing within said fluid flow path prior to discharge from the discharge orifice to reduce spraying of the dispensed fluid, said means comprising a hub concentrically positioned within fluid flow path of the elongated body, a rear section of said hub having a bore formed therein.

13. An apparatus for straightening the stream of a fluid flowing through a fluid flow path as it exits the discharge orifice of a fluid dispensing device to reduce spraying of the fluid at discharge orifice, comprising:

an annular frame positioned within the fluid flow path of the discharge device;

a hub concentrically positioned within the frame, the hub having a generally cylindrical front section with a conical tip orientated toward the discharge orifice and a rear section orientated toward the fluid stream, said rear section having a bore formed therein;

at least three spokes extending between the hub and the frame and positioned about the hub and positioned equidistance around the hub so as to divide the stream of fluid flowing through the choke into separate substantially linearly aligned streams, one of said spokes having a bore formed therein and in fluid communication with the bore of the rear section of the hub, whereby the separate linearly aligned streams flow along the front section of the hub and converge at the discharge orifice in a substantially constricted, linearly aligned stream and thereby straightened to reduce spraying of the fluid at the discharge orifice.

14. An apparatus for straightening the stream of fluid flowing through a fluid flow path as it exits the discharge orifice of a fluid dispensing device to reduce spraying of the fluid at discharge orifice, comprising:

an annular body positioned within the fluid flow path of the discharge device, said body having an anterior section and a posterior section, said anterior section having a tapered bore formed therein;

a hub concentrically positioned within the body at the posterior section, the hub having a generally cylindrical front section orientated toward the discharge orifice and a rear section orientated toward the fluid stream, said rear section having a bore formed therein;

at least three spokes extending between the hub and the frame and positioned and positioned equidistance around the hub so as to divide the stream of fluid flowing through the choke into separate substantially linearly aligned streams, one of said spokes having an extension thereon for engaging a sensing port in the fluid dispensing device with a bore formed therethrough and in fluid communication with the bore of the rear section of the hub, whereby the separate linearly aligned streams flow along the front section of the hub and through the tapered bore of the body front section to converge at the discharge orifice in a substantially constricted, linearly aligned stream and thereby straightened to reduce spraying of the fluid at the discharge orifice.

15. A method of straightening the stream of a fluid flowing through a fluid flow path as it exits the discharge orifice of a fluid dispensing device to reduce spraying of the fluid at discharge, comprising;

slowing the stream of fluid as it flows towards the discharge orifice;

dividing the flowing stream by means of a choke positioned within the fluid discharge device, said choke comprising a frame positioned within the fluid flow path of the discharge device, a hub concentrically positioned within the frame, the hub having a forward section oriented toward the discharge orifice and a rear section oriented towards the fluid stream, said rear section of the hub having a bore formed therein, a plurality of spokes extending between the hub and the frame and positioned about the hub so as to divide the stream of fluid flowing through the choke into a plurality of separate substantially linearly aligned streams;

dividing the stream of flowing fluid into a plurality of separate, substantially linearly aligned fluid streams by passing the fluid through the choke;

converging said plurality of separate, substantially linearly aligned fluid streams at a point adjacent the discharge orifice to create a relatively constricted linearly aligned fluid stream at the discharge orifice wherein said relatively constricted, linearly aligned fluid stream exits the discharge orifice with reduced spraying of liquid beyond the discharge orifice.

16. The method of claim 15 wherein the stream of fluid is divided into three separate, substantially linearly aligned fluid streams.

17. The method of claim 15 wherein the choke further comprises a sensing port pathway therethrough.

18. The method of claim 15 wherein the choke is comprised of a substantially rigid material resistant to deterioration by flowing fuel.

* * * * *